US010294644B2

(12) United States Patent
Saeki et al.

(10) Patent No.: US 10,294,644 B2
(45) Date of Patent: May 21, 2019

(54) FLUSH TOILET

(71) Applicant: LIXIL Corporation, Tokyo (JP)

(72) Inventors: Akiya Saeki, Tokyo (JP); Hiroaki Watanabe, Tokyo (JP); Yukihiro Inoue, Tokyo (JP); Tooru Higashino, Tokyo (JP); Masato Takeda, Tokyo (JP); Akiya Oohira, Tokyo (JP); Takeya Ichiyanagi, Tokyo (JP); Yasuhiro Kondo, Tokyo (JP); Hironao Inoue, Tokyo (JP); Tetsuo Hata, Tokyo (JP)

(73) Assignee: LIXIL CORPORATION, Tokyo (JP)

( * ) Notice: Subject to any disclaimer, the term of this patent is extended or adjusted under 35 U.S.C. 154(b) by 0 days.

(21) Appl. No.: 15/594,770

(22) Filed: May 15, 2017

(65) Prior Publication Data

US 2017/0247870 A1 Aug. 31, 2017

Related U.S. Application Data

(63) Continuation of application No. PCT/JP2015/073865, filed on Aug. 25, 2015.

(30) Foreign Application Priority Data

Nov. 25, 2014 (JP) ..... 2014-238164

(51) Int. Cl.
*E03D 9/08* (2006.01)
*E03D 9/03* (2006.01)
(Continued)

(52) U.S. Cl.
CPC ..... *E03D 9/032* (2013.01); *E03D 5/01* (2013.01); *E03D 9/007* (2013.01); *E03D 9/08* (2013.01);
(Continued)

(58) Field of Classification Search
CPC .. E03D 1/01; E03D 1/26; E03D 11/02–11/11; E03D 11/13; E03D 2201/40; E03D 9/032; E03D 9/08
(Continued)

(56) References Cited

U.S. PATENT DOCUMENTS 9,850,646 B2 * 12/2017 Mizoguchi ..... E03D 9/08

FOREIGN PATENT DOCUMENTS

CN 101078235 A 11/2007
CN 203514457 U 4/2014
(Continued)

OTHER PUBLICATIONS

International Search Report from International Application No. PCT/JP2015/073865 dated Nov. 17, 2015.
(Continued)

*Primary Examiner* — David P Angwin
*Assistant Examiner* — Nicholas A Ros
(74) *Attorney, Agent, or Firm* — Muncy, Geissler, Olds & Lowe, P.C.

(57) ABSTRACT

Afforded are: a toilet body including a toilet bowl part, a rim conduit 36, and a rim part; and a functional component mounted on an upper surface part of the toilet body, rearward of the toilet bowl part. The upper surface part includes a cut-out part formed such as to be recessed downward from the other part of the upper surface part. The functional component is disposed on the cut-out part such as to be partially positioned downward with respect to an upper surface of the rim part, and such as to be partially stuck out into the toilet bowl part from upon the cut-out part, and, on a bottom surface of the stuck-out part, the functional component is provided with a conduit forming surface serving as an upper surface of the rim conduit.

10 Claims, 13 Drawing Sheets

(51) Int. Cl.

| | |
|---|---|
| ***E03D 11/02*** | (2006.01) |
| ***E03D 5/01*** | (2006.01) |
| ***E03D 11/04*** | (2006.01) |
| ***E03D 9/00*** | (2006.01) |
| ***E03D 11/08*** | (2006.01) |
| *E03D 9/02* | (2006.01) |
| *E03D 9/04* | (2006.01) |
| *E03D 9/05* | (2006.01) |
| *E03D 9/052* | (2006.01) |

(52) U.S. Cl.
CPC ..... *E03D 11/02* (2013.01); *E03D 11/04* (2013.01); *E03D 11/08* (2013.01); *E03D 9/02* (2013.01); *E03D 9/04* (2013.01); *E03D 9/05* (2013.01); *E03D 9/052* (2013.01); *E03D 2009/028* (2013.01)

(58) Field of Classification Search
USPC ..... 4/329, 420.1–420.5, 443–448
See application file for complete search history.

(56) References Cited

FOREIGN PATENT DOCUMENTS

| | | | | | |
|---|---|---|---|---|---|
| EP | 2261428 | | * | 12/2010 | ..... E03D 9/08 |
| EP | 2261428 | A1 | | 12/2010 | |
| JP | H05-081377 | U | | 11/1993 | |
| JP | 2010-024780 | A | | 2/2010 | |
| JP | 2010-174451 | A | | 8/2010 | |
| JP | 2010-196375 | A | | 9/2010 | |
| JP | 5257846 | B2 | | 5/2013 | |
| TW | 469317 | B | | 12/2001 | |
| WO | WO-2007/114298 | A1 | | 10/2007 | |

OTHER PUBLICATIONS

Chinese Intellectual Property Office, Search Report, dated Nov. 14, 2018, 2 pages, with English translation (4 pages).
Taiwanese Intellectual Property Office, Office Action, dated Dec. 25, 2018, 5 pages, with English translation (9 pages).

* cited by examiner

FLUSH TOILET

BACKGROUND OF THE INVENTION

1. Field of the Invention

The present invention relates to flush toilets.

2. Description of the Related Art

Flush toilets are sometimes provided with a functional component in which various devices are unitized, such as a perineal area washing unit. The functional component generally includes a casing having an opening on its front surface, a perineal area washing nozzle capable of moving forward and backward through the opening of the casing, and a shutter used to open and close the opening.

The functional component is ordinarily mounted on an upper surface part of a toilet body at the rear part of the toilet body which includes a toilet bowl part (reference is made to Patent Document 1). When the functional component is mounted on the toilet body in this way, however, the height of the functional component with respect to the rim part may be higher at the rear part of the toilet body, which may cause negative effects on the appearance. As a countermeasure thereto, in Patent Document 1, a recessed groove is provided on the upper surface part of the rear part of the toilet body such as to accommodate part of the functional component within the recessed groove, making the height of the functional component with respect to the rim part being reduced.

RELATED ART

Patent Documents

Patent Document 1 Japanese Patent No. 5257846

In Patent Document 1, however, a rim conduit is formed on an upper inner peripheral part of the toilet bowl part, and part of the rim conduit is formed by an outer surface of the shutter. Accordingly, flush water flowing along the rim conduit could flow in through a gap between the shutter and the recessed groove, which may cause water leakage through the opening into the casing.

SUMMARY OF THE INVENTION

The present invention has been made in view of such a problem, and a purpose thereof is to provide a flush toilet in which water leakage into the functional component can be prevented easily, while the height of the functional component with respect to the rim part is made being reduced.

To solve the problems above, a flush toilet of an embodiment of the present invention comprises: a toilet body including a toilet bowl part, a rim conduit formed along a circumferential direction on an upper inner peripheral part of the toilet bowl part, and a rim part provided extending outward from an upper edge part of the toilet bowl part; and a functional component mounted on an upper surface part of the toilet body, rearward of the toilet bowl part; wherein the upper surface part includes a cut-out part formed such as to be recessed downward from the other part of the upper surface part; and the functional component is disposed on the cut-out part such as to be partially positioned downward with respect to an upper surface of the rim part, and such as to be partially stuck out into the toilet bowl part from upon the cut-out part, and on a bottom surface of its stuck-out part, the functional component is provided with a conduit forming surface serving as an upper surface of the rim conduit.

According to this embodiment, part of internal devices in the functional component can be disposed to be positioned downward with respect to the upper surface of the rim part, thereby making the height of the internal devices with respect to the rim part, and also the height of the functional component with respect to the rim part, being reduced. Also, an opening provided on a casing of the functional component is positioned forward of the conduit forming surface, so that water leakage through the opening into the casing can be prevented easily, compared to the case where the conduit forming surface is formed by a shutter, which opens and closes the opening of the functional component.

The present invention provides a flush toilet in which water leakage into the functional component can be prevented easily, while the height of the functional component with respect to the toilet bowl part is made being reduced.

DETAILED DESCRIPTION OF THE INVENTION

Figure 1:
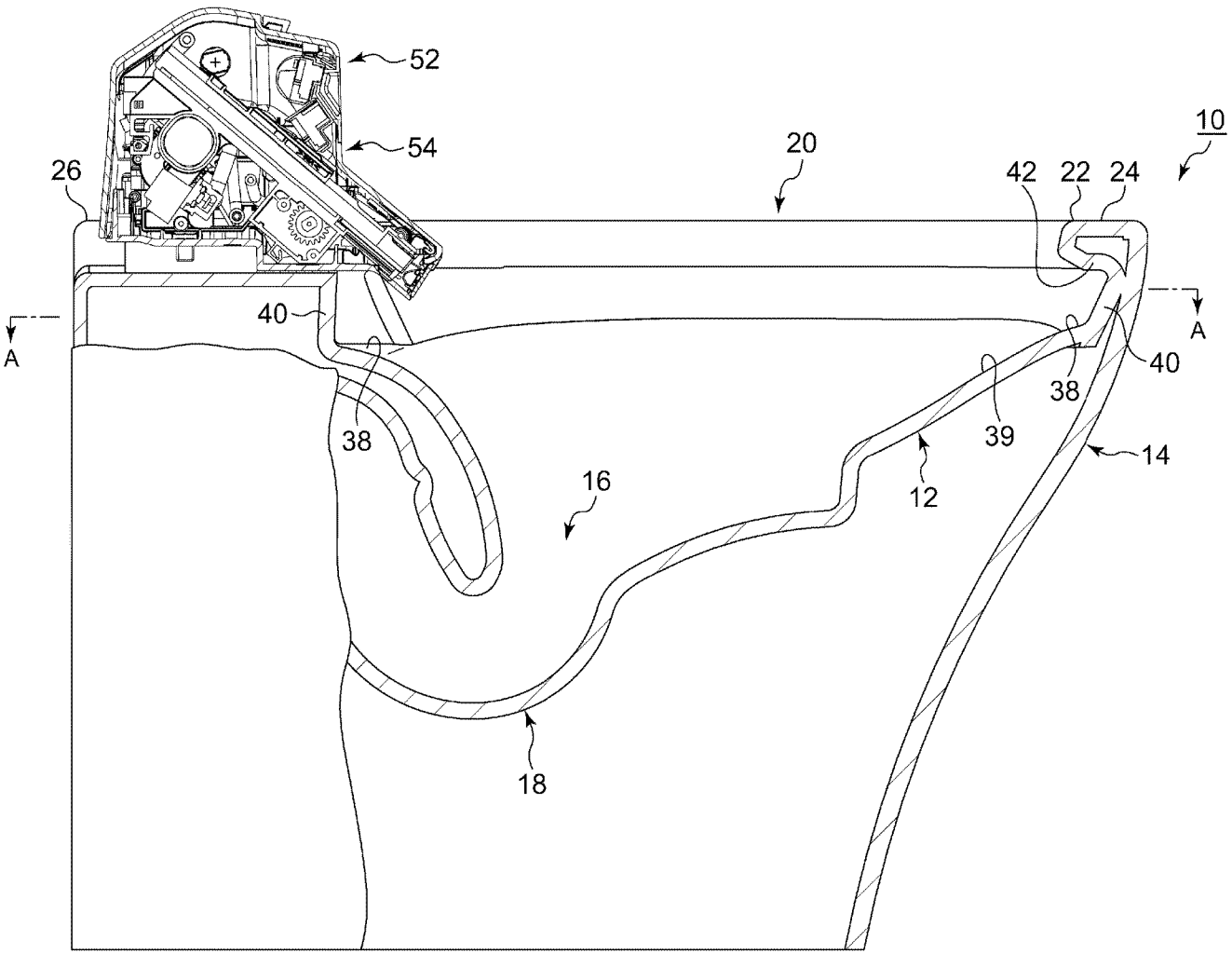
FIG. 1 is a side partial sectional view of a flush toilet according to a first embodiment.

In each of the following embodiments, like reference characters designate like constituent elements, and the description thereof will not be repeated. Also, part of the constituent elements may be omitted in each drawing, for the sake of convenience.

[First Embodiment]

FIG. 1 is a side partial sectional view of a flush toilet 10 according to the first embodiment. In the following description, the front, rear, left, and right sides will be expressed based on the direction of a user sitting in a normal posture on the seat (not illustrated) of the flush toilet 10. The flush toilet 10 comprises a toilet body 14 including a toilet bowl part 12. The toilet bowl part 12 is provided in a front part of the toilet body 14, and, through an inlet 16 formed therebelow, the toilet bowl part 12 communicates with a trap part 18 serving as drainage.

Figure 2:
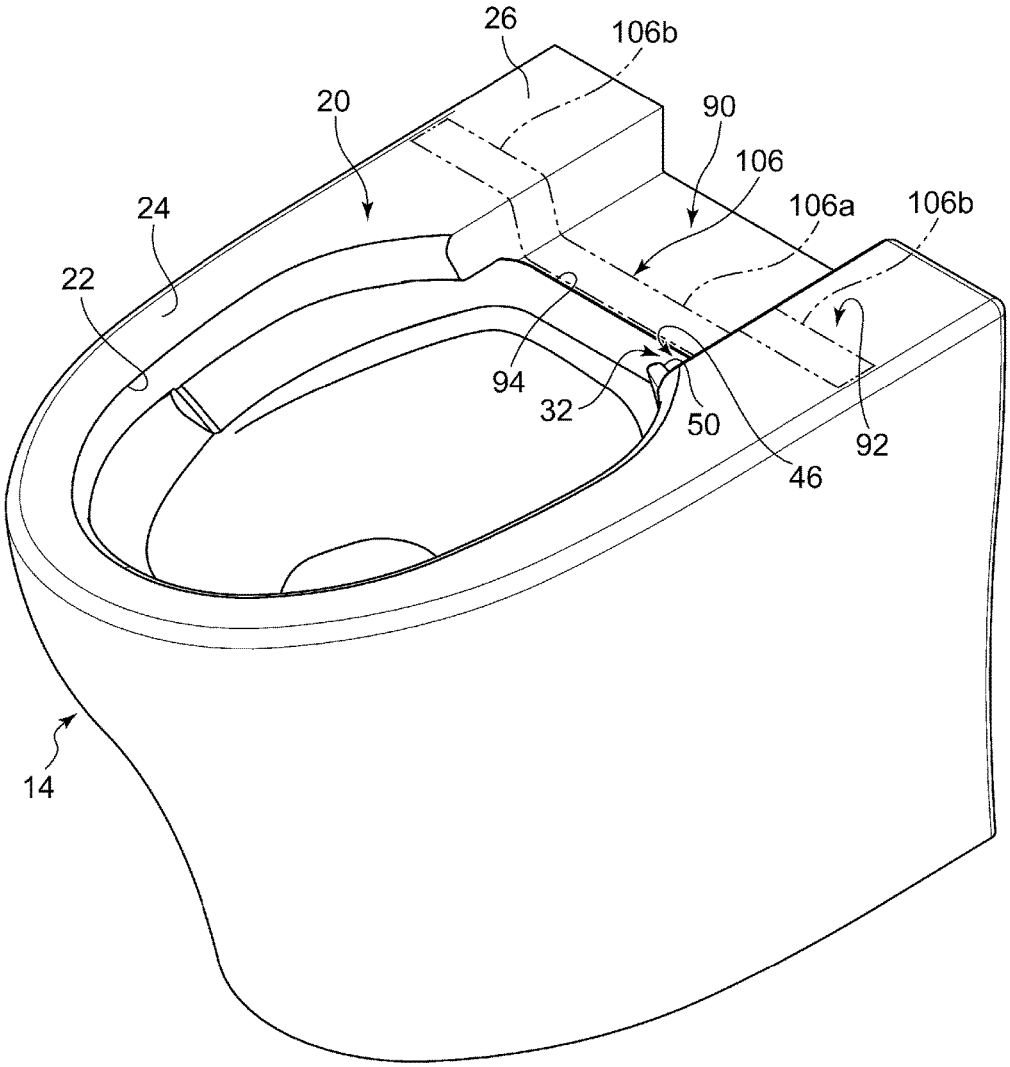
FIG. 2 is a perspective view that shows the state where the functional component has been removed from the toilet body according to the first embodiment.

FIG. 2 is a perspective view that shows the state where a functional component 52, which will be described later, has been removed from the toilet body 14. As shown in FIGS. 1 and 2, an upper surface part 20 of the toilet body 14 includes a rim part 24 that extends to the front and the both sides from an upper edge part 22 of the toilet bowl part 12, and a pedestal part 26 provided continuously with the rim part 24 rearward of the toilet bowl part 12.

Figure 3:
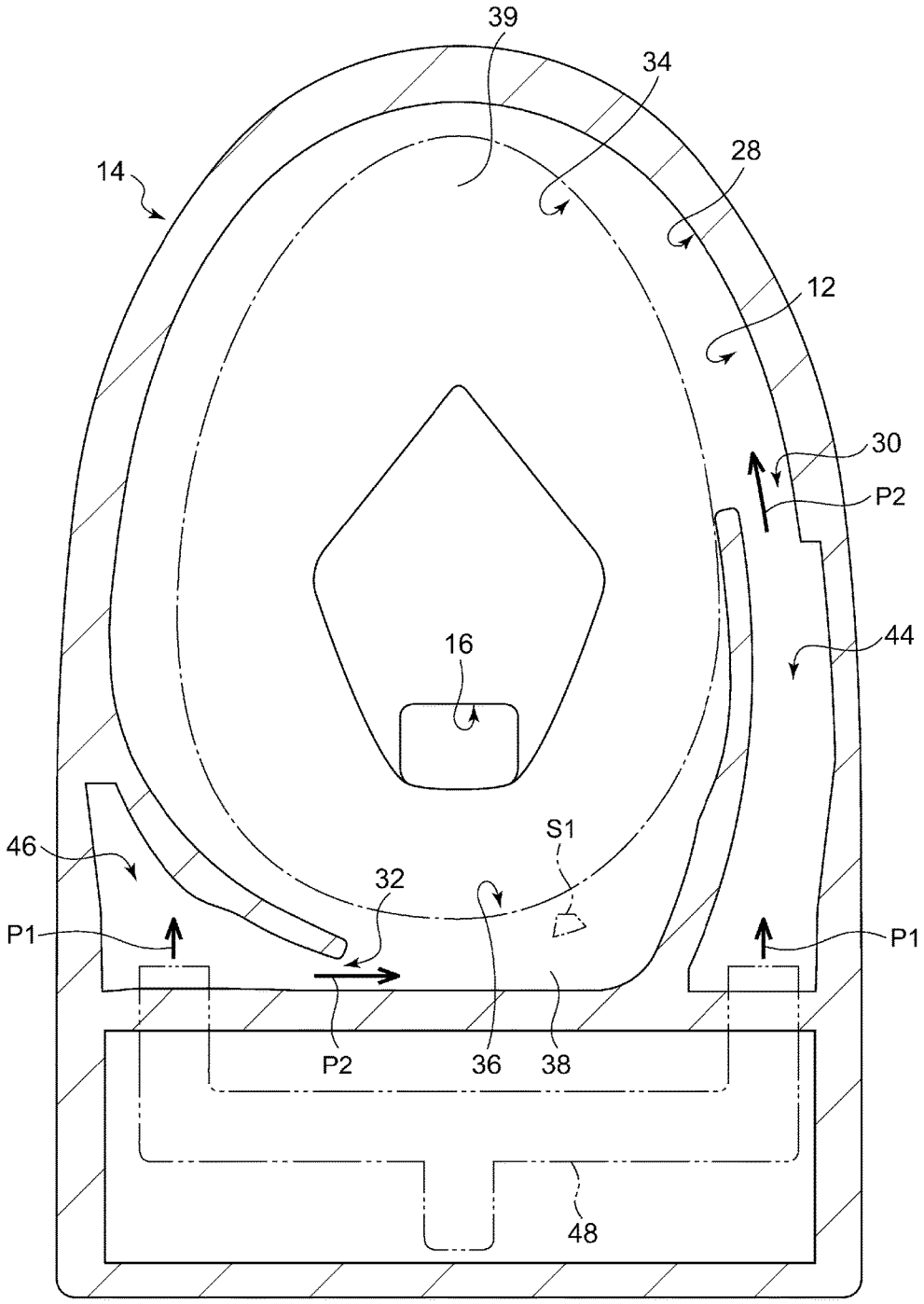
FIG. 3 is a plan sectional view of the toilet body according to the first embodiment.

FIG. 3 is a plan sectional view of the toilet body 14. FIG. 3 is also a sectional view taken along line A-A in FIG. 1. In an upper inner peripheral part 28 of the toilet bowl part 12, a first water discharge port 30 is formed at a position closer to one side (the right side in FIG. 3) in left-and-right direction, and also closer to the front side of the toilet bowl part 12. Also, a second water discharge port 32 is formed at a position closer to the other side (the left side in FIG. 3) in left-and-right direction, and also closer to the rear side of the toilet bowl part 12, in the upper inner peripheral part 28 of the toilet bowl part 12.

Also on the upper inner peripheral part 28 of the toilet bowl part 12, a first rim conduit 34 and a second rim conduit 36 are provided to lead flush water discharged from the respective water discharge ports 30 and 32 such as to be swirled. In FIG. 3, the dashed dotted line indicates the boundary between a shelf part 38 of the rim conduits 34 and 36, which will be described later, and a waste receiver 39 provided continuously and inward from an inner peripheral edge part of the shelf part 38.

The first rim conduit 34 is formed to extend from the first water discharge port 30 to the vicinity of the second water discharge port 32 in the counterclockwise direction in plan view, along a circumferential direction of the upper inner peripheral part 28 of the toilet bowl part 12. Also, the second rim conduit 36 is formed to extend from the second water discharge port 32 to the vicinity of the first water discharge port 30 in the counterclockwise direction in plan view, along a circumferential direction of the upper inner peripheral part 28 of the toilet bowl part 12.

As shown in FIG. 1, each of the rim conduits 34 and 36 is configured by the shelf part 38 extending inward such as to face upward, and a standing wall part 40 standing from an outer edge part of the shelf part 38. The first rim conduit 34 is also configured by a folded-back part 42 extending inward from an upper edge part of the standing wall part 40. Similarly, the second rim conduit 36 is also partly configured by the folded-back part 42 extending inward from the upper edge part of the standing wall part 40, as shown in FIG. 2.

On the toilet body 14, a first water passage 44, having a hollow structure and continuing to the first water discharge port 30, is formed on the upstream side of the first water discharge port 30, as shown in FIG. 3. Also on the toilet body 14, a second water passage 46, having a hollow structure and continuing to the second water discharge port 32, is formed on the upstream side of the second water discharge port 32. Flush water is supplied from a flush water supply device 48 in directions P1, and the flush water flows through each of the water passages 44 and 46 and is then discharged from the respective water discharge ports 30 and 32 into the toilet bowl part 12 in directions P2. On the second water passage 46, an opening port 50, which opens upward, is formed on its downstream end immediately before the second water discharge port 32, as shown in FIG. 2.

Figure 4:
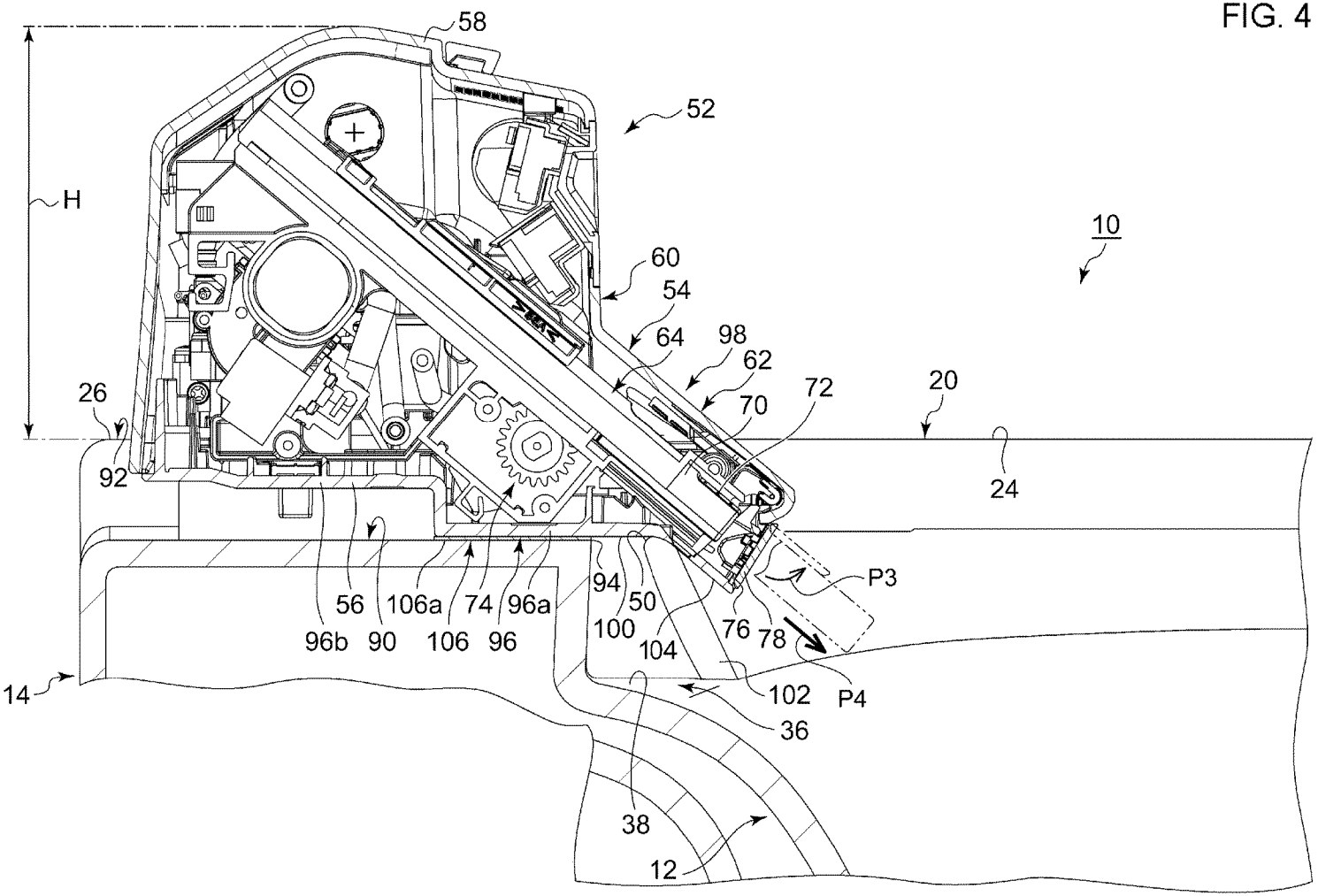
FIG. 4 is a partially magnified view of FIG. 1.

FIG. 4 is a partially magnified view of FIG. 1. The flush toilet 10 further comprises the functional component 52, which is attached to the pedestal part 26 of the toilet body 14 with a fixing structure, such as screws, rearward of the toilet bowl part 12. The functional component 52 is configured by unitizing multiple internal devices having different functions, such as perineal area washing, warm air drying, and deodorization.

The functional component 52 comprises a casing 54 for housing multiple internal devices. The casing 54 comprises a base plate 56 mounted on the pedestal part 26 of the toilet body 14, and a case cover 58 fitted to the base plate 56 such as to cover the multiple internal devices mounted on the base plate 56. The casing 54 has a body part 60 of a box shape, and a protruding part 62 protruding obliquely downward from a lower part of the front part of the body part 60. Inside the body part 60 and protruding part 62, a continuous internal space is formed.

Figure 5:
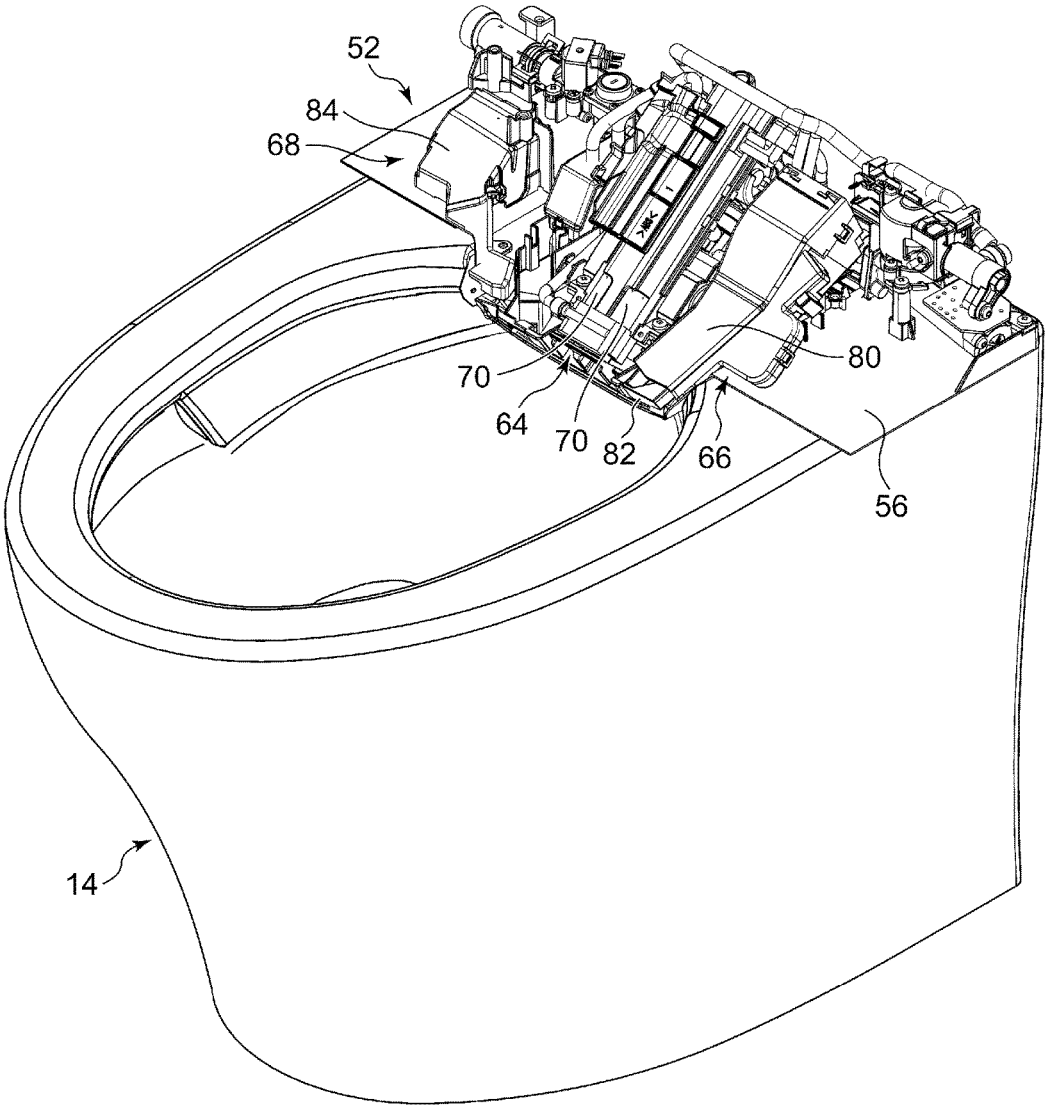
FIG. 5 is a perspective view that shows the state where the case cover of the functional component mounted on the toilet body of the first embodiment has been removed.
Figure 6:
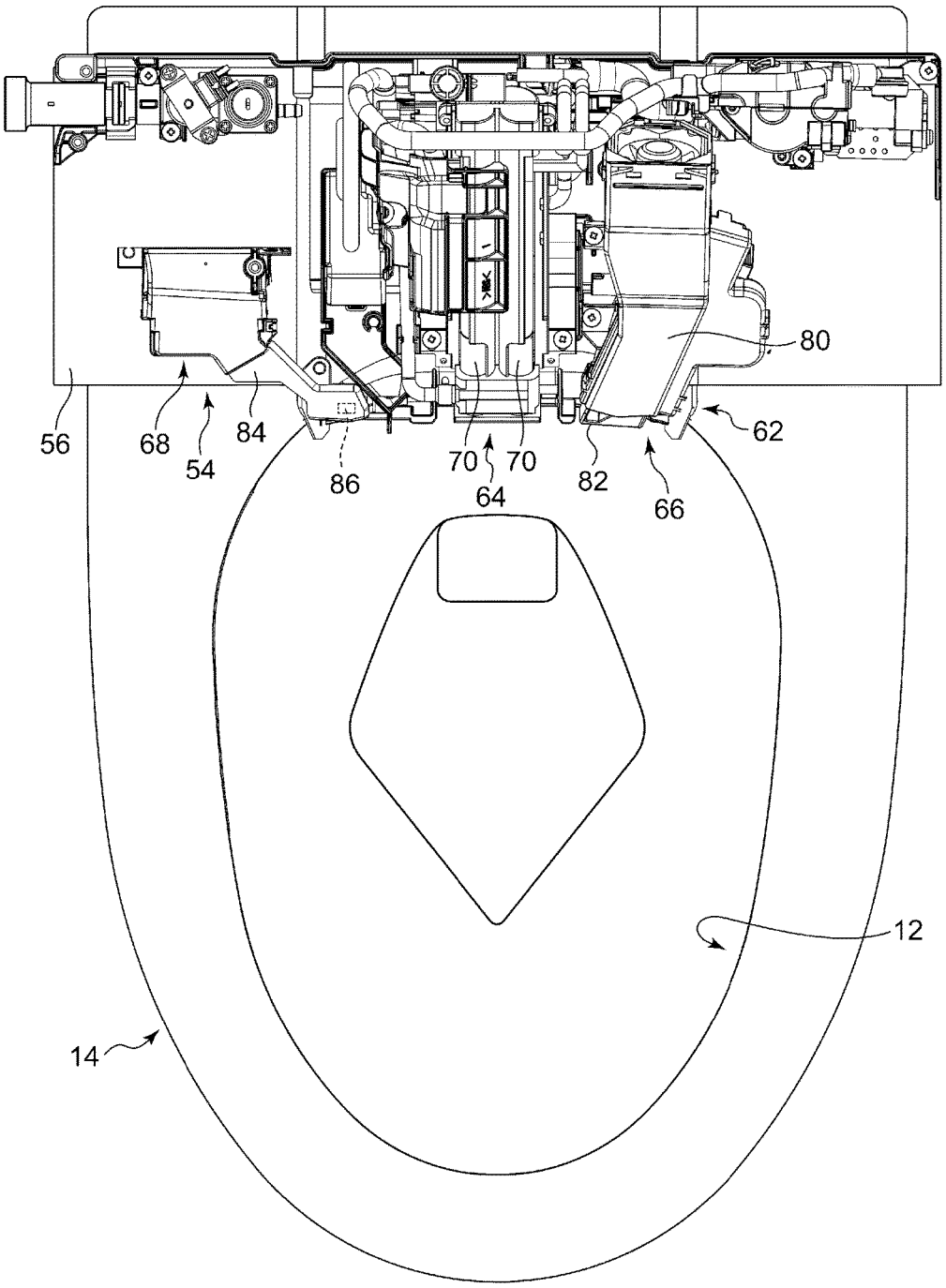
FIG. 6 is a plan view that shows the state where the case cover of the functional component mounted on the toilet body of the first embodiment has been removed.

FIG. 5 is a perspective view that shows the state where the case cover 58 of the functional component 52 mounted on the toilet body 14 has been removed, and FIG. 6 is a plan view thereof. The multiple internal devices include a nozzle unit 64 driven for perineal area washing, a warm air drying unit 66 driven for warm air drying, and a deodorizing unit 68 for removing odors produced within the toilet bowl part 12.

The nozzle unit 64 includes a pair of perineal area washing nozzles 70 (hereinafter, simply referred to as nozzles 70) arranged side by side in left-and-right direction. The pair of nozzles 70 are used for washing the perineal area of humans by washing water; one is an anus washing nozzle, and the other is a bidet nozzle. Each of the nozzles 70 has a cylindrical shape and is mounted on the base plate 56 such as to be tilted downward toward the front side, as shown in FIG. 4. Also, the lower end part of each of the nozzles 70 is housed in the protruding part 62 of the casing 54 and provided with a spray hole 72 from which washing water is sprayed. Each of the nozzles 70 is driven in both the axial directions by a linear motion mechanism 74, such as a rack and pinion mechanism.

Figure 7:
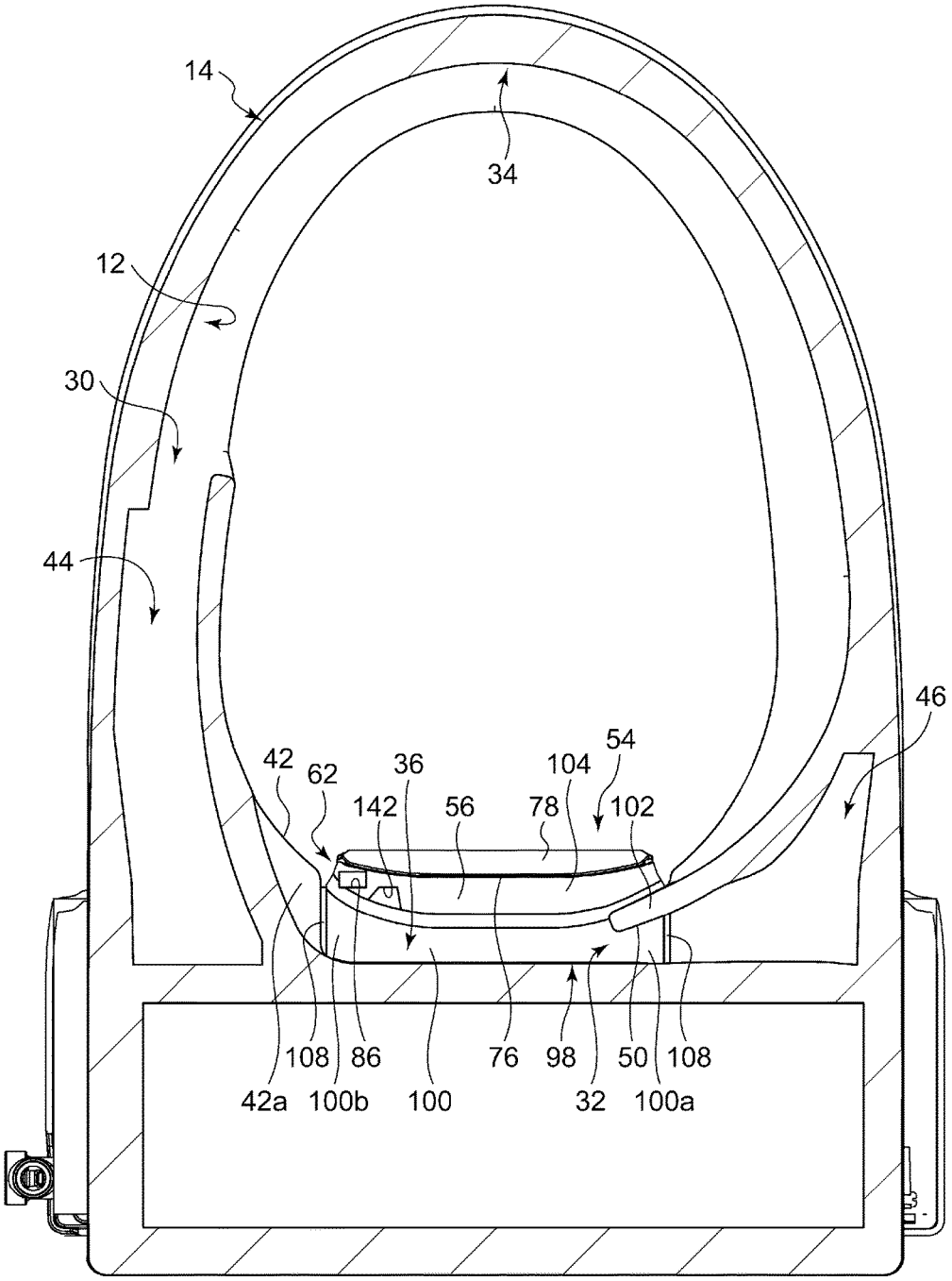
FIG. 7 is a sectional view of the toilet body according to the first embodiment, showing each rim conduit viewed from the underneath.

FIG. 7 is a sectional view of the toilet body 14, showing each of the rim conduits 34 and 36 viewed from the underneath. FIG. 7 is also a sectional view taken along line A-A in FIG. 1, viewed from the underneath. On the front surface of the protruding part 62 of the casing 54, an opening 76, which is long in left-and-right direction and opens obliquely downward, is provided, and a shutter 78 used to open and close the opening 76 is also provided on the protruding part 62 of the case cover 58, as shown in FIGS. 4 and 7. The shutter 78 has a plate shape long in left-and-right direction. The shutter 78 is rotatably connected to the case cover 58 via a rotational shaft (not illustrated) and biased by a biasing member (not illustrated), such as a spring, toward a closed position at which the opening 76 is closed.

When a nozzle 70 is driven forward in the axial direction by the linear motion mechanism 74, the lower end part of the nozzle 70 touches the inner surface of the shutter 78 and opens the opening 76 with rotating the shutter 78 in a direction P3 about the rotational shaft, and the nozzle 70 moves forward in a direction P4 such as to protrude from the opening 76 (see the dashed double-dotted lines in FIG. 4). When a nozzle 70 is driven backward in the axial direction by the linear motion mechanism 74 from the state where the nozzle 70 is protruding from the opening 76, the nozzle 70 recedes from the opening 76 and is housed within the casing 54, so that the shutter 78 is moved by the biasing member to a position where the opening 76 is closed. In this way, each of the nozzles 70 can move forward and backward through the opening 76.

As shown in FIGS. 5 and 6, the warm air drying unit 66 comprises a warm air duct 80 mounted on the base plate 56 on one side (the right side in the figures) of the nozzle unit 64. The warm air duct 80 is disposed such that the downstream end thereof is tilted downward toward the front side. The tip part of the warm air duct 80 positioned on the lower side thereof is housed in the protruding part 62 of the casing 54 and provided with an expulsion port 82 facing inside the toilet bowl part 12. In the warm air drying unit 66, outside air is introduced, with a first fan (not illustrated) driven, into the warm air duct 80 and warmed by a first heater (not illustrated), and the warm air that has passed through the first heater then blows out forward from the expulsion port 82.

The deodorizing unit 68 comprises a deodorization duct 84 mounted on the base plate 56 on the other side (the left side in the figures) of the nozzle unit 64. The deodorization duct 84 is disposed so that the upstream end thereof is tilted downward toward the front side. The tip part of the deodorization duct 84 positioned on the lower side thereof is housed in the protruding part 62 of the casing 54. On the base plate 56 of the casing 54, an air suctioning port 86 facing inside the toilet bowl part 12 is formed (see also FIG. 7), and the deodorization duct 84 communicates with the inside of the toilet bowl part 12 through the air suctioning port 86. In the deodorizing unit 68, air within the toilet bowl part 12 is introduced, with a second fan (not illustrated) driven, into the deodorization duct 84 via the air suctioning port 86, and odors included in the air are removed by a deodorizing cartridge (not illustrated). The air that has passed through the deodorizing cartridge is expelled outside the toilet bowl part 12 from an exhaust port (not illustrated) via an exhaust duct (not illustrated).

The pedestal part 26 of the upper surface part 20 of the toilet body 14 includes a cut-out part 90 provided in a region facing the casing 54 of the functional component 52 in a vertical direction, as shown in FIGS. 2 and 4. The cut-out part 90 is provided in a region facing a middle part in a left-and-right direction of the casing 54. The cut-out part 90 is formed such as to be recessed downward from the other parts 92 (hereafter, referred to as neighboring parts 92) of the upper surface part 20, which are positioned on the left and right sides of the cut-out part 90 and provided continuously with and adjacent to the cut-out part 90. The upper surfaces of the neighboring parts 92 are formed to be evenly continuous with the upper surface of the rim part 24. The cut-out part 90 is formed such as to make a concaved-shape recessed downward from the neighboring parts 92 when viewed from the front side. The cut-out part 90 is provided as a continuous groove-shape located in a range from the rear edge of the upper surface part 20 to a region rearward of the toilet bowl part 12. The cut-out part 90 is provided with an opening 94 that faces the toilet bowl part 12 (see FIG. 2).

Figure 8:
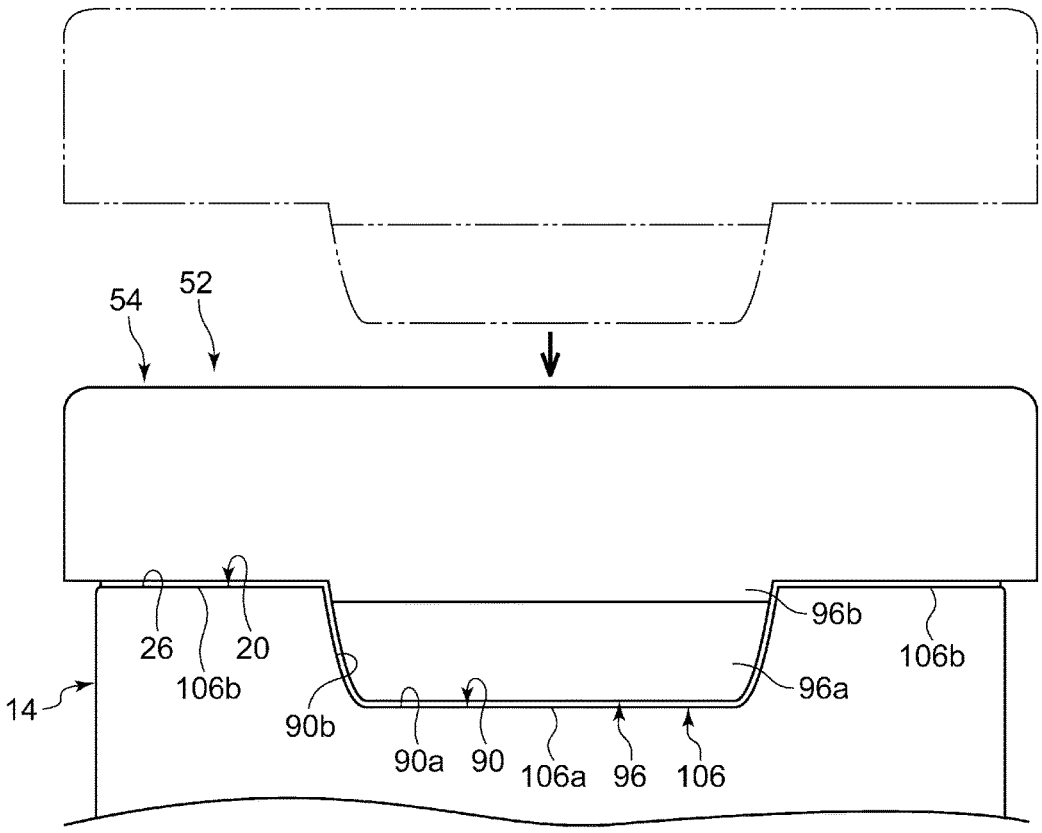
FIG. 8 is a diagram that schematically shows the flush toilet according to the first embodiment viewed from the rear side.

FIG. 8 is a diagram that schematically shows the flush toilet 10 viewed from the rear side.

The cut-out part 90 includes a bottom surface part 90*a* on the bottom side with a planer-shape, and side surface parts 90*b* with a curved-shape, standing from the bottom surface part 90*a*, and continuing to a neighboring part 92. The bottom surface part 90*a* may also be formed to have a curved-shape, which may smoothly continue to the side surface parts 90*b*.

As shown in FIGS. 4 and 8, a fitting part 96 protruding downward is formed in a middle part in a left-and-right direction of the lower surface part of the casing 54. The fitting part 96 is formed to extend in a front-and-back direction on the casing 54, and a front portion 96*a* thereof protrudes more largely than a rear portion 96*b* thereof. The fitting part 96 is disposed on the cut-out part 90 such as to be positioned downward with respect to the upper surface of the rim part 24. The front portion 96*a* of the fitting part 96 is fitted into the cut-out part 90. Also, the rear portion 96*b* of the fitting part 96 is disposed within the cut-out part 90. The fitting part 96 may be formed such that the amount of protrusion of the rear portion 96*b* is identical with that of the front portion 96*a*.

As shown in FIG. 4, the functional component 52 is disposed such that the protruding part 62, which is part of the functional component 52, sticks out into the toilet bowl part 12 through the opening 94 from upon the cut-out part 90 (see also FIG. 2). In this stuck-out part 98 of the functional component 52, the lower end parts of the pair of the nozzles 70, the lower end part of the deodorization duct 84 (see FIG. 6), and the lower end part of the warm air duct 80 are housed within the casing 54.

On the bottom surface of the stuck-out part 98, a conduit forming surface 100 is provided, as shown in FIGS. 4 and 7. The conduit forming surface 100 extends long in a left-and-right direction and is evenly formed such as to be parallel with a horizontal plane. The opening 76 on the casing 54 of the functional component 52 is positioned forward of the conduit forming surface 100.

One side end part 100*a* (the right end part in FIG. 7) of the conduit forming surface 100 in left-and-right direction covers the opening port 50 of the second water passage 46 from the upper side (see also FIG. 2) and serves as the upper surface of the second water passage 46. The one side end part 100*a* of the conduit forming surface 100 is provided such as to be adjacent to the upper surface of the second water passage 46 in left-and-right direction, and flush with it. The one side end part 100*a* of the conduit forming surface 100 is partially mounted on a separating wall part 102, which separates the downstream end of the second water passage 46 and the toilet bowl part 12, and an extension surface 104 is provided forward of the separating wall part 102, as will be described later.

The remaining parts of the conduit forming surface 100 other than the one side end part 100*a*, i.e., a middle part and the other side end part 100*b* in the left-and-right direction, are provided such as to face the shelf part 38 of the second rim conduit 36 and serve as the upper surface of the second rim conduit 36. The other side end part 100*b* of the conduit forming surface 100 is provided such as to be adjacent to the lower surface of the folded-back part 42 of the second rim conduit 36 in left-and-right direction. The middle part and the other side end part 100*b* of the conduit forming surface 100 are provided such as to be flush with the lower surface 42*a* of the folded-back part 42 of the second rim conduit 36, i.e., the upper surface of the second rim conduit 36 in the toilet bowl part 12. Being flush here means to provide in such a way as to uniform the height position of the upper surface of the second rim conduit 36 on the toilet bowl part 12, and the height position of the middle part and the other side end part 100*b* of the conduit forming surface 100.

On the bottom surface of the stuck-out part 98, the extension surface 104 is formed which extends obliquely downward in front of the conduit forming surface 100. As with the conduit forming surface 100, the extension surface 104 extends long in a left-and-right direction and smoothly curves such as to form a downward convex as approaching from both the left and right ends to the middle part.

As shown in FIGS. 4 and 8, a first seal member 106 is interposed between the functional component 52 and the toilet body 14. The first seal member 106 is formed of an elastic body, such as rubber. The first seal member 106 is provided to inhibit water leakage from the inside of the toilet bowl part 12 through the opening 94 into the rear side of the cut-out part 90. The first seal member 106 includes a first section 106*a* interposed between the fitting part 96 of the casing 54 and the cut-out part 90 of the toilet body 14, and second sections 106*b* interposed between the toilet body 14 and regions of the lower surface part of the casing 54 on the left and right sides of the fitting part 96. In FIG. 2, the dashed double-dotted line indicates the position of the first seal member 106.

Also, second seal members 108 are interposed between the side surface parts of the stuck-out part 98 of the functional component 52 and parts of the toilet body 14 facing the side surface parts in left-and-right direction, as shown in FIG. 7. The second seal members 108 are also formed of an elastic body, such as rubber. The second seal members 108 are provided to inhibit water leakage through gaps between the side surface parts of the stuck-out part 98 and the parts of the toilet body 14, to the upper side.

There will now be described effects of the flush toilet 10 set forth above. As shown in FIG. 4, in the flush toilet 10, the fitting part 96, which is part of the functional component 52, is disposed on the cut-out part 90 such as to be positioned downward with respect to the upper surface of the rim part 24. Thus, part of the internal devices of the functional component 52 can be disposed to be positioned downward with respect to the upper surface of the rim part 24, thereby making the height of the internal devices with respect to the rim part 24, and also the height H (see FIG. 4) of the functional component 52 with respect to the rim part 24, being reduced. The part of the internal devices here means the nozzles 70 of the nozzle unit 64, the warm air duct 80 of the warm air drying unit 66 (see FIG. 6), and the deodorization duct 84 of the deodorizing unit 68 (see FIG. 6).

Also, part of the functional component 52 is provided such as to stick out into the toilet bowl part 12 from upon the cut-out part 90, and, on the bottom surface of the stuck-out part 98, the conduit forming surface 100 is provided. Accordingly, the opening 76 of the functional component 52 is positioned forward of the conduit forming surface 100, so that water leakage through the opening 76 into the casing 54 can be prevented easily, compared to the case where the conduit forming surface 100 is formed by the shutter 78 that opens and closes the opening 76 of the functional component 52.

Also, in the flush toilet 10, the extension surface 104, extending downward in front of the conduit forming surface 100, is formed on the bottom surface of the stuck-out part 98 of the functional component 52. Accordingly, when flush water flows through the second rim conduit 36, the extension surface 104 blocks a splash scattering forward, thereby preventing scattering in a large area.

Also, as shown in FIG. 7, the lower surface 42*a* of the folded-back part 42, also serving as the upper surface of the second rim conduit 36 in the toilet bowl part 12, is provided such as to be flush with the middle part and the other side end part 100*b* of the conduit forming surface 100 of the functional component 52, so that bumps and dents are unlikely to occur between the upper surface of the second rim conduit 36 and the conduit forming surface 100. Accordingly, flush water can flow smoothly through the second rim conduit 36 without receiving resistance from bumps and dents between the upper surface of the second rim conduit 36 and the conduit forming surface 100.

The flush toilet 10 according to the present embodiment also has features with regard to a method for discharging waste water generated in the functional component 52.

Figure 9:
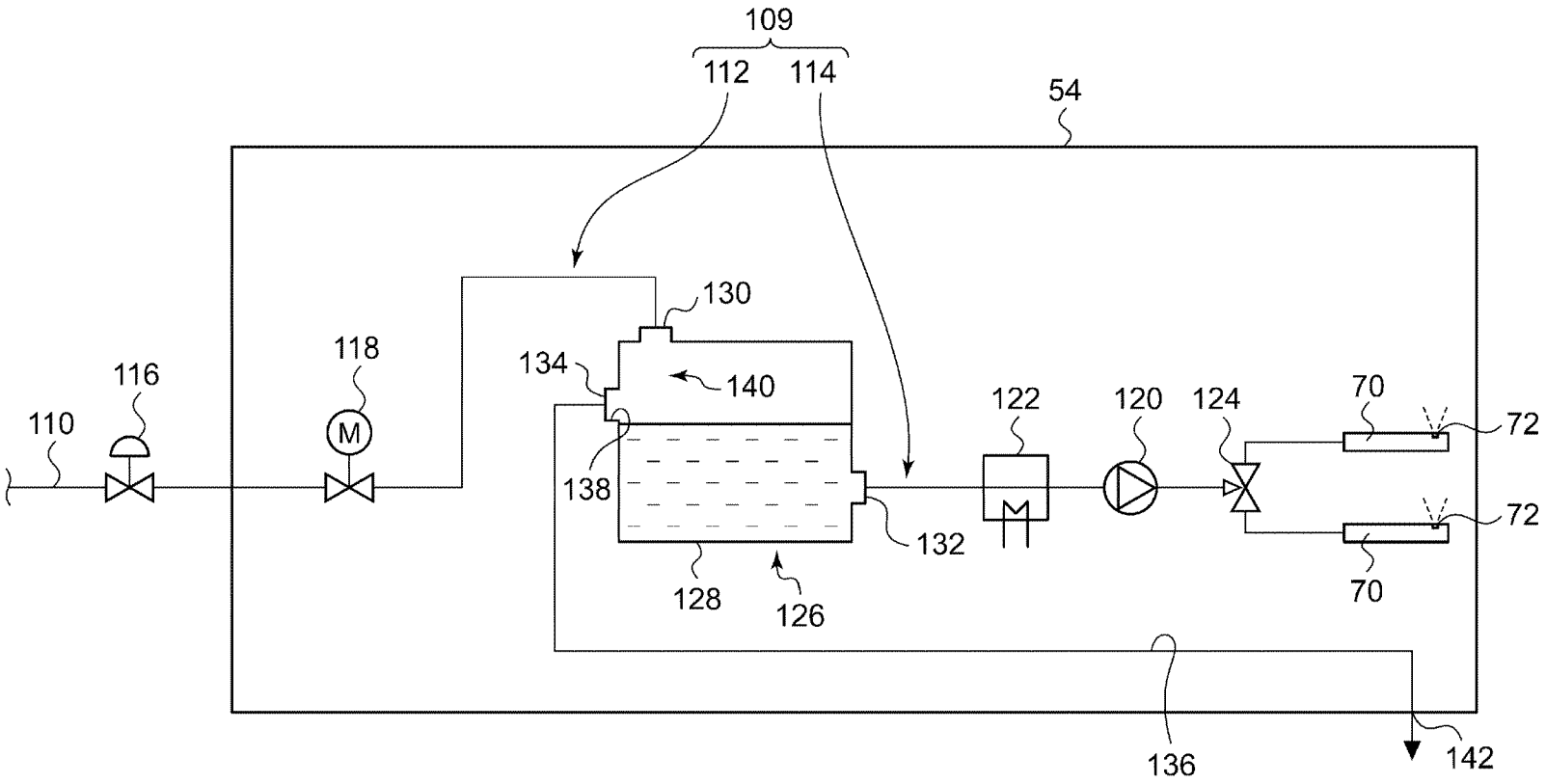
FIG. 9 is a block diagram that shows a configuration of a water supply line for supplying washing water to nozzles according to the first embodiment.

FIG. 9 is a block diagram that shows a configuration of a water supply line 109 for supplying washing water to each of the nozzles 70. The water supply line 109 connects a water distributing pipe 110 as a service water line and multiple nozzles 70. The water supply line 109 includes a first-side water line 112 and a second-side water line 114, which are arranged in series. In the middle of the first-side water line 112, there are provided a water shut-off valve 116, and a solenoid valve 118 for selectively switching between a state of supplying water downstream and a state of shutting off water, by energization. In the middle of the second-side water line 114, there are provided a pump 120 for suctioning water from the upstream side and delivering the water to the downstream side, a second heater 122 provided on the upstream side of the pump 120 to heat water suctioned by the pump 120, and a changeover valve 124 for selectively switching, among the multiple nozzles 70, the destination of water supplied downstream by the pump 120.

The functional component 52 includes an air gap device 126 that connects the lines 112 and 114. The air gap device 126 is provided in the middle of the water supply line 109. The air gap device 126 is provided to prevent, if sewage enters the second-side water line 114 through a spray hole 72 of a nozzle 70 and negative pressure is caused on the water distributing pipe 110 side of the first-side water line 112, backflow of the sewage from the second-side water line 114 to the first-side water line 112.

The air gap device 126 includes an open tank 128 (hereinafter, simply referred to as a tank 128) for storing water therein, an inflow port 130 through which water flows in from the first-side water line 112, and an outflow port 132 through which water flows out from the tank 128 to the second-side water line 114. This means water flowing through the water supply line 109 goes through the tank 128. A side surface of the tank 128 of the air gap device 126 is provided with an overflow port 134, and a drain passage 136 communicating with the tank 128 through the overflow port 134 is connected to the tank 128 on the downstream side of the overflow port 134. The drain passage 136 is configured by a rubber hose or the like that connects the overflow port 134 and a drainage outlet 142, which will be described later. The lower edge of the overflow port 134 corresponds to an overflow edge 138.

When stored water in the tank 128 reaches a water level exceeding the overflow edge 138 (hereinafter, referred to as an overflow water level), waste water overflowing from the tank 128 is discharged through the overflow port 134 and drain passage 136. The water level of stored water in the tank 128 is maintained at the overflow water level or lower, and, between the water surface of the stored water and the inflow port 130, an air gap 140 is formed as a gap space. The air gap 140 prevents backflow from the second-side water line 114 through the tank 128 to the first-side water line 112.

Here, as shown in FIG. 7, on the bottom surface of the stuck-out part 98 of the functional component 52, the drainage outlet 142 for discharging waste water from the drain passage 136 is formed. In FIG. 3, the dashed dotted line S1 indicates a region just beneath the drainage outlet 142. The drainage outlet 142 is formed on the extension surface 104 of the casing 54 and above the shelf part 38 at a midway of the second rim conduit 36, as shown in FIGS. 3 and 7. Waste water from the drainage outlet 142 is discharged downward to the shelf part 38 of the second rim conduit 36. Accordingly, scattering of a splash caused by waste water reaching the second rim conduit 36 is more likely to be blocked by the functional component 52, so that scattering in a large area can be prevented easily, compared to the case where waste water is discharged to the waste receiver 39 of the toilet bowl part 12.

The present embodiment describes an example in which waste water to be discharged from the drainage outlet 142 overflows from the tank 128 used for the air gap device 126. However, as long as water flowing through the water supply line 109 for supplying water to a water discharge part, such as a nozzle 70, goes through the tank 128, the tank 128 need not necessarily be used for the air gap device 126. Also in this case, water may overflow from the tank 128 when the water pressure within the water supply line 109 is increased, and the water then flows through the drain passage 136 to be discharged from the drainage outlet 142, so that excessive increase in water pressure can be prevented. Also in this case, the functional component 52 is configured to include the tank 128, and the drain passage 136 through which waste water overflowing from the tank 128 is discharged.

[Second Embodiment]

Figure 10:
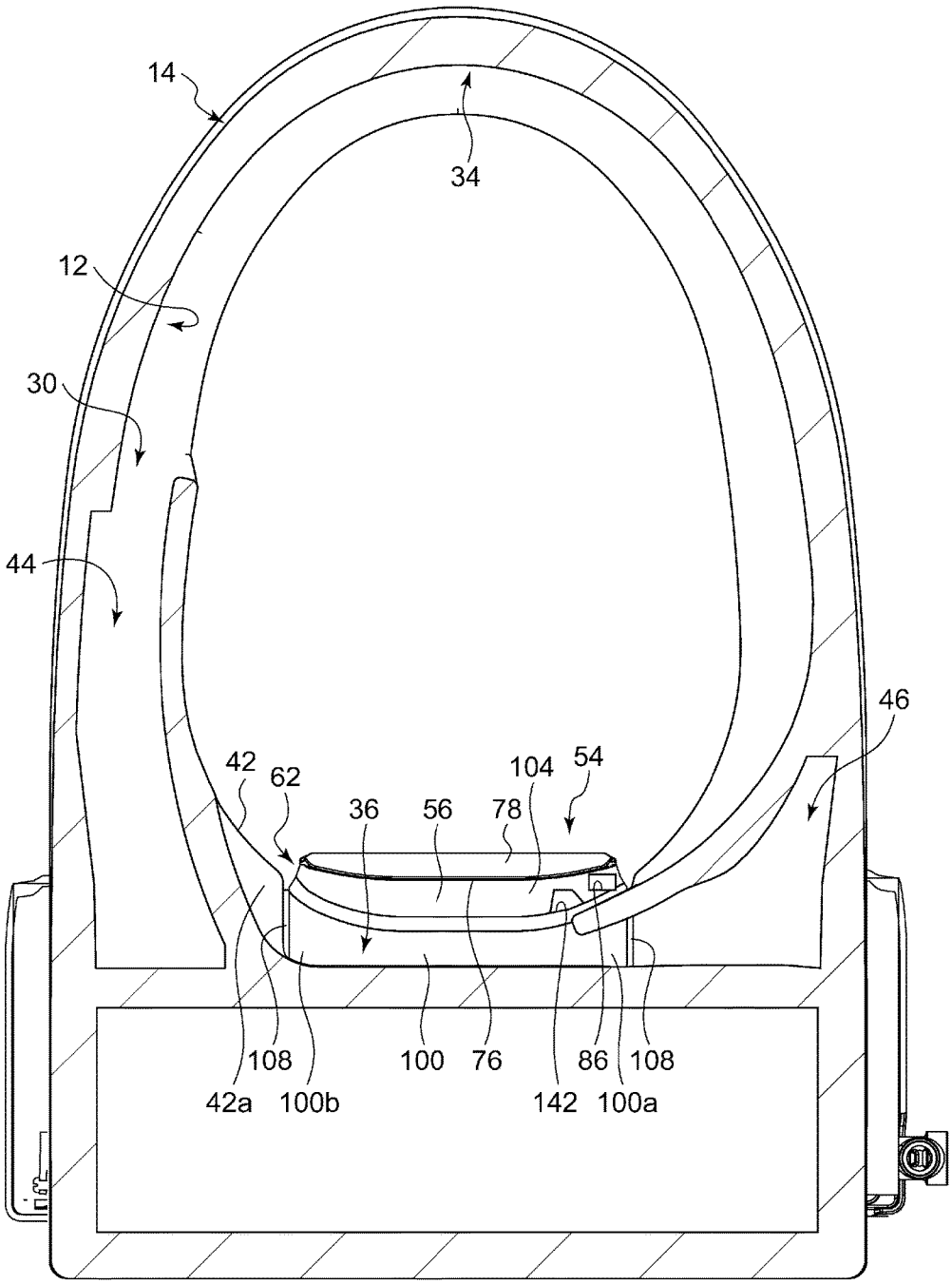
FIG. 10 is a sectional view of a toilet body according to a second embodiment, showing each rim conduit viewed from the underneath.
Figure 11:
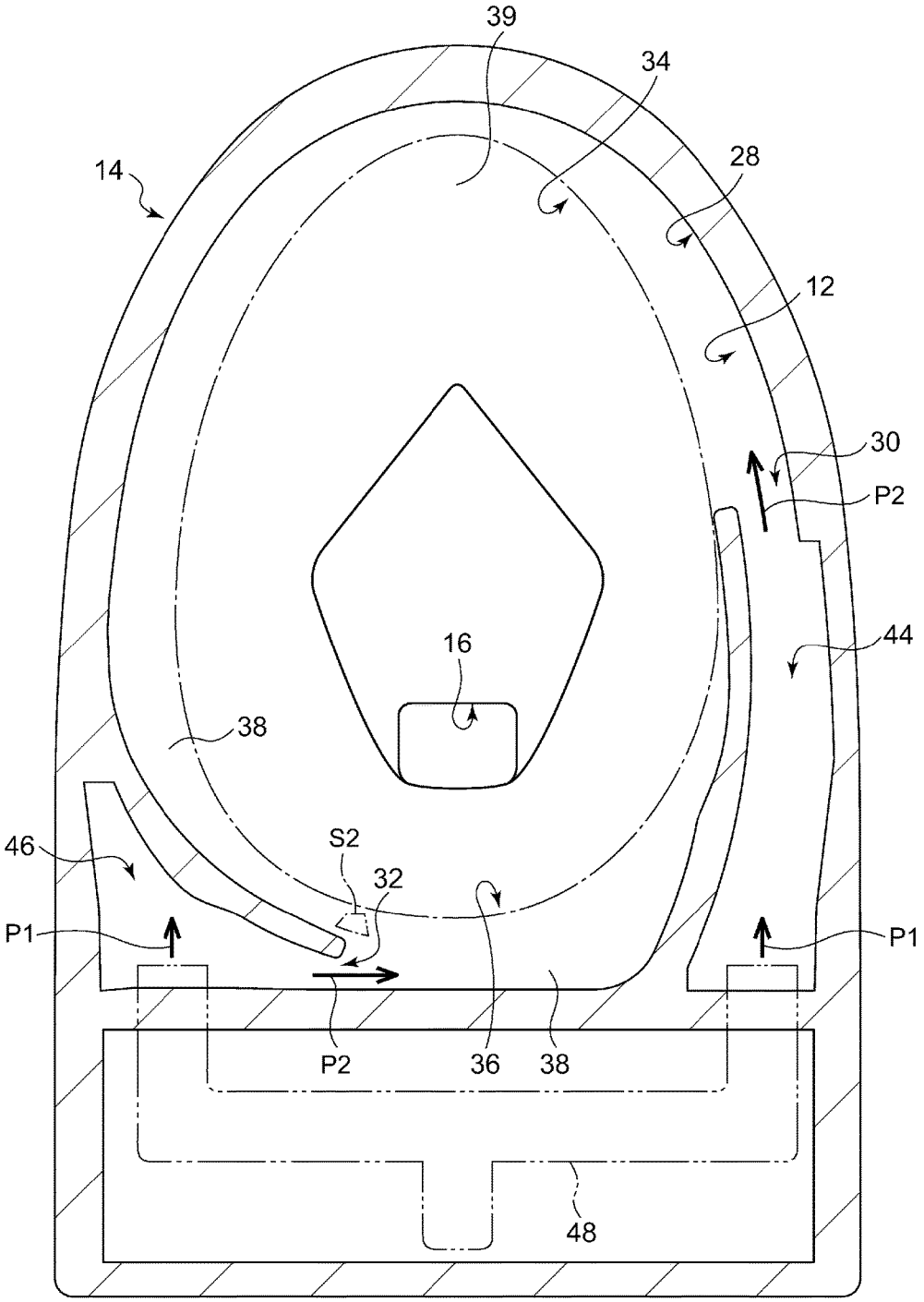
FIG. 11 is a plan sectional view of the toilet body according to the second embodiment.

FIG. 10 is a sectional view of the toilet body 14 according to the second embodiment, showing each of the rim conduits 34 and 36 viewed from the underneath, and FIG. 11 is a plan sectional view of the toilet body 14. In the example of FIGS. 3 and 7, the drainage outlet 142 is formed above the shelf part 38 of the second rim conduit 36. The dashed dotted line S2 in FIG. 11 indicates a region just beneath the drainage outlet 142 in the present embodiment. In this way, the drainage outlet 142 according to the present embodiment is formed on the extension surface 104 of the casing 54 and above the shelf part 38 at the downstream end of the first rim conduit 34. Waste water from the drainage outlet 142 is discharged downward to the shelf part 38 of the first rim conduit 34.

Accordingly, compared to the length of the path from the second water discharge port 32 to the discharge point of waste water on the second rim conduit 36 in the example of FIGS. 3 and 7, the length of the path from the first water discharge port 30 to the discharge point of waste water on the first rim conduit 34 in the present embodiment is longer. Namely, the drainage outlet 142 is formed at a midway of the second rim conduit 36 in the example of FIG. 3, whereas the drainage outlet 142 is formed at the downstream end of the first rim conduit 34, which is longer than the second rim conduit 36, in the present embodiment. Accordingly, when flush water is discharged from each of the discharge ports 30 and 32, the force of the flush water flowing under the drainage outlet 142 is weaker in the present embodiment than in the example of FIGS. 3 and 7, so that backflow of flush water into the casing 54 through the drainage outlet 142 is less likely to occur.

[Third Embodiment]

Figure 12:
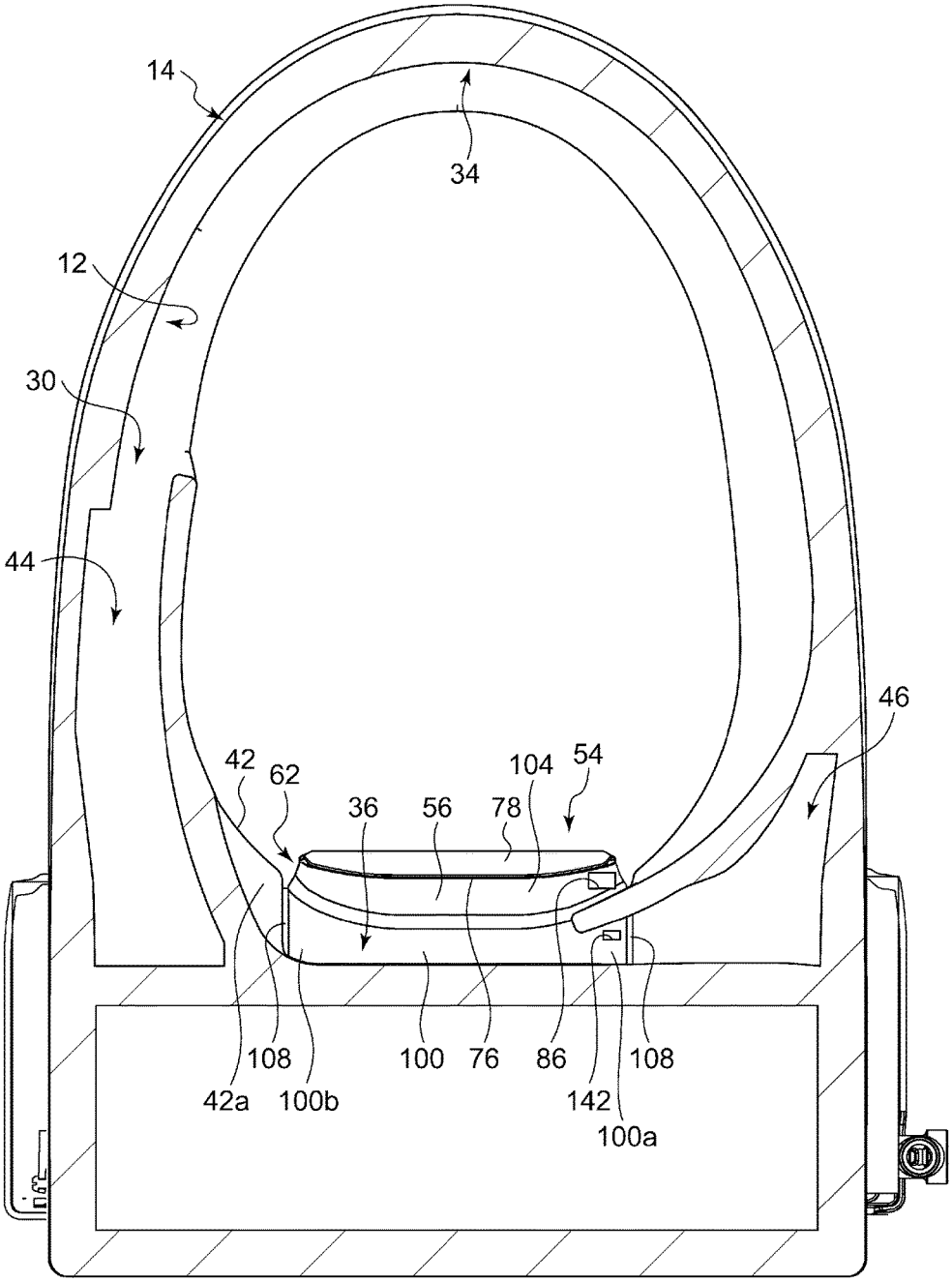
FIG. 12 is a sectional view of a toilet body according to a third embodiment, showing each rim conduit viewed from the underneath.
Figure 13:
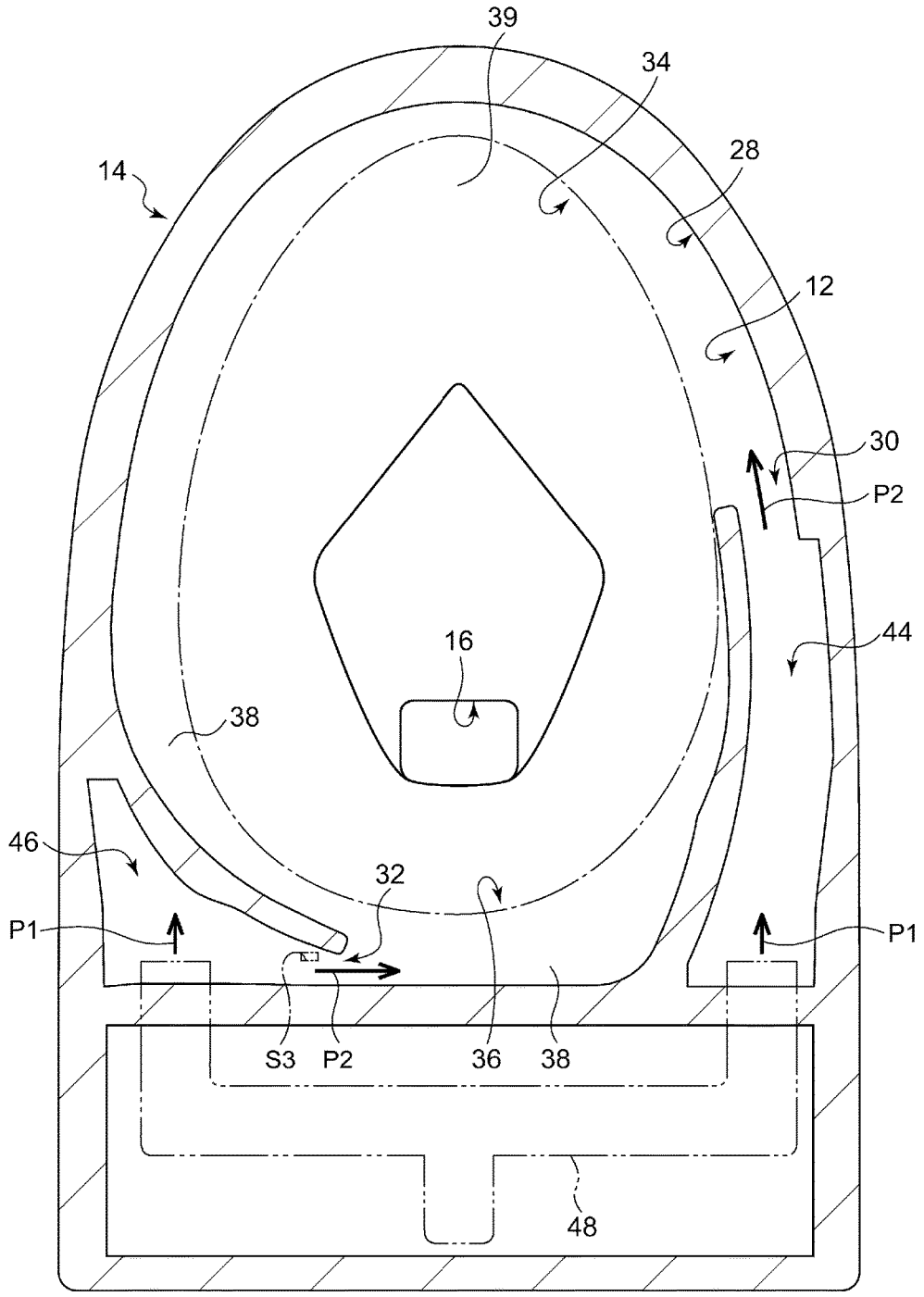
FIG. 13 is a plan sectional view of the toilet body according to the third embodiment.

FIG. 12 is a sectional view of the toilet body 14 according to the third embodiment, showing each of the rim conduits 34 and 36 viewed from the underneath, and FIG. 13 is a plan sectional view of the toilet body 14. In FIG. 13, the dashed dotted line S3 indicates a region just beneath the drainage outlet 142. In this way, the drainage outlet 142 according to the present embodiment is formed on the conduit forming surface 100 of the casing 54, and formed not above the shelf part 38 of the rim conduit 34 or 36, but above the lower surface of the second water passage 46. Waste water from the drainage outlet 142 is discharged downward to the second water passage 46.

Accordingly, a splash caused by waste water reaching the second water passage 46 is less likely to scatter to the inside of the toilet bowl part 12, so that scattering in a large area can be prevented, compared to the case where waste water is discharged to the rim conduit 34 or 36. The drainage outlet 142 may be formed above the first water passage 44 instead of the second water passage 46.

The present invention has been described with reference to embodiments, which merely describe principles and applications of the present invention. Also, various modifications or changes in arrangement may be made to the embodiments without departing from the scope of ideas of the invention defined in claims.

There has been described the example in which the cut-out part 90 is provided in a region facing a middle part in a left-and-right direction of the casing 54, which is part of the functional component 52; however, the cut-out part 90 may be provided in a region facing the entire functional component 52 in a vertical direction. In this case, the cut-out part 90 is formed such as to be recessed downward from the rim part 24, which is the other part of the upper surface part 20 provided continuously with and adjacent to the cut-out part 90 in back-and-front direction. In any case, the cut-out part 90 has only to be provided in a region facing at least part of the functional component 52 in a vertical direction and to be formed such as to be recessed downward from the other part of the upper surface part provided continuously with and adjacent to the cut-out part 90.

There has been described the example in which the conduit forming surface 100 is evenly formed such as to be parallel with a horizontal plane; however, the conduit forming surface 100 may be formed to be inclined with respect to a horizontal plane, or may be formed to be curved instead of being formed plane. Also, although there has been described the example in which the extension surface 104 extends obliquely downward in front of the conduit forming surface 100, the extension surface 104 may be provided to extend vertically downward.

Although not illustrated, the casing 54 may be formed so that the upper edge part 22 of the toilet bowl part (see FIG. 1) and the casing 54 (see FIG. 1) are smoothly continuous with each other, without any angular part at the boundaries in plan view. In this case, the contour of the upper edge part 22 of the toilet bowl part 12 and the casing 54 may form an ellipse, or a polygon, such as a quadrangle, of which the angular parts are curved.

When the inventions embodied by the embodiments and modifications set forth above are generalized, the following technical ideas are derived.

In the flush toilet of the embodiment described previously in means to solve the problems, an extension surface, extending downward in front of the conduit forming surface, may be formed on the bottom surface of the stuck-out part.

According to this embodiment, when flush water flows through the rim conduit, the extension surface blocks a splash scattering forward, thereby preventing scattering in a large area.

In the flush toilet of the embodiment described previously, the upper surface of the rim conduit on the toilet bowl part, and the conduit forming surface may be provided such as to be flush with each other.

According to this embodiment, bumps and dents are unlikely to occur between the upper surface of the rim conduit and the conduit forming surface. Therefore, flush water can flow smoothly through the rim conduit without receiving resistance from bumps and dents between the upper surface of the rim conduit and the conduit forming surface.

In the flush toilet of the embodiment described previously, a drainage outlet for discharging waste water from the functional component into the rim conduit may be formed on the bottom surface of the stuck-out part of the functional component.

According to this embodiment, scattering of a splash caused by waste water reaching the rim conduit is more likely to be blocked by the functional component, so that scattering in a large area can be prevented, compared to the case where waste water is discharged to the waste receiver of the toilet bowl part.

In the flush toilet of the embodiment described previously, the toilet body may include a water passage for passing flush water supplied from a flush water supply device, and a water discharge port through which flush water that has flowed through the water passage is discharged into the toilet bowl part. Also, a drainage outlet for discharging waste water from the functional component into the water passage may be formed on the bottom surface of the stuck-out part of the functional component.

According to this embodiment, a splash caused by waste water reaching the water passage is less likely to scatter to enter the toilet bowl part, so that scattering in a large area can be prevented, compared to the case where waste water is discharged to the rim conduit.

What is claimed is:

1. A flush toilet, comprising: a toilet body including a toilet bowl part, a rim conduit formed along a circumferential direction on an upper inner peripheral part of the toilet bowl part, and a rim part provided extending outward from an upper edge part of the toilet bowl part; and a casing mounted on an upper surface part of the toilet body, rearward of the toilet bowl part; wherein the casing houses internal devices; wherein the upper surface part includes a cut-out part formed such as to be recessed downward from the other part of the upper surface part; and the casing is disposed on the cut-out part such as to be partially positioned downward with respect to an upper surface of the rim part, and such as to be partially stuck out into the toilet bowl part from upon the cut-out part, and on a bottom surface of its stuck-out part, the casing is provided with a conduit forming surface serving as an upper surface of the rim conduit.

2. The flush toilet of claim 1, wherein on the bottom surface of the stuck-out part of the casing, a drainage outlet for discharging waste water from the casing into the rim conduit is formed.

3. The flush toilet of claim 1, wherein: the toilet body includes a water passage for passing flush water supplied from a flush water supply device, and a water discharge port through which flush water that has flowed through the water passage is discharged into the toilet bowl part; and on the bottom surface of the stuck-out part of the casing, a drainage outlet for discharging waste water from the casing into the water passage is formed.

4. The flush toilet of claim 1, wherein on the bottom surface of the stuck-out part, an extension surface extending downward in front of the conduit forming surface is formed.

5. The flush toilet of claim 4, wherein the upper surface of the rim conduit on the toilet bowl part, and the conduit forming surface are provided such as to be flush with each other.

6. The flush toilet of claim 4, wherein on the bottom surface of the stuck-out part of the casing, a drainage outlet for discharging waste water from the casing into the rim conduit is formed.

7. The flush toilet of claim 4, wherein: the toilet body includes a water passage for passing flush water supplied from a flush water supply device, and a water discharge port through which flush water that has flowed through the water passage is discharged into the toilet bowl part; and on the bottom surface of the stuck-out part of the casing, a drainage outlet for discharging waste water from the casing into the water passage is formed.

8. The flush toilet of claim 1, wherein the upper surface of the rim conduit on the toilet bowl part, and the conduit forming surface are provided such as to be flush with each other.

9. The flush toilet of claim 8, wherein on the bottom surface of the stuck-out part of the casing, a drainage outlet for discharging waste water from the casing into the rim conduit is formed.

10. The flush toilet of claim 8, wherein: the toilet body includes a water passage for passing flush water supplied from a flush water supply device, and a water discharge port through which flush water that has flowed through the water passage is discharged into the toilet bowl part; and on the bottom surface of the stuck-out part of the casing, a drainage outlet for discharging waste water from the casing into the water passage is formed.

* * * * *